United States Patent [19]

Pollak

[11] Patent Number: 4,815,393

[45] Date of Patent: Mar. 28, 1989

[54] TABLE WITH AN EXTENDABLE TABLE PLATE

[76] Inventor: Otto-Franz Pollak, Klosterhofstr. 32, 6940 Weinheim-Luetzelsachsen, Fed. Rep. of Germany

[21] Appl. No.: 108,479

[22] Filed: Oct. 13, 1987

[30] Foreign Application Priority Data

Oct. 15, 1986 [DE] Fed. Rep. of Germany ..... 3635083

[51] Int. Cl.[4] ..... A47B 1/04

[52] U.S. Cl. ..... 108/69; 108/65

[58] Field of Search ..... 108/69, 63, 65, 66, 108/77, 86, 90, 70, 78

[56] References Cited

U.S. PATENT DOCUMENTS

| | | | |
|---|---|---|---|
| 1,088,612 | 2/1914 | Neumann | 108/70 |
| 1,524,943 | 2/1925 | Miller | 108/63 |
| 2,305,343 | 12/1942 | Gadbois | 108/69 X |
| 2,492,139 | 12/1949 | Eliason | 108/66 |
| 2,614,013 | 10/1952 | Langius | 108/69 |
| 2,703,740 | 3/1955 | Cochard | 108/66 |
| 3,494,307 | 2/1970 | Kagan | 108/69 |
| 4,069,770 | 1/1978 | Bertelson | 108/66 |
| 4,069,771 | 1/1978 | Bertelson | 108/66 |

FOREIGN PATENT DOCUMENTS

| | | | |
|---|---|---|---|
| 1340068 | 9/1963 | France | 108/69 |
| 1383125 | 11/1964 | France | 108/69 |
| 409305 | 4/1934 | United Kingdom | 108/63 |

*Primary Examiner*—Peter A. Aschenbrenner
*Assistant Examiner*—José V. Chen
*Attorney, Agent, or Firm*—Michael J. Striker

[57] ABSTRACT

A table plate of an expandable table is provided with a plurality of leaves which are slidable into and from compartments formed under the table plate and are mounting-free. Each leaf includes a plate and a disk-shaped holding element which are alternatingly insertable into the compartments.

9 Claims, 7 Drawing Sheets

13
18
11
10
II
13
18
12
12

13
16
14
15
17
11
10
13
17
16
14
15

TABLE WITH AN EXTENDABLE TABLE PLATE

BACKGROUND OF THE INVENTION

The present invention relates to a table having a table plate which may be expanded if necessary by extension leaves.

Tables of the type under discussion are widely used.

Conventional tables use mounts for extension leaves, which make conversion of the table are used for extension leaves possible so that the usable surface of the table plate is enlarged.

It has been recognized however that the use of mountings in such tables is rather expensive, and the disadvantage of such structures is also that in order to obtain an enlarged usable surface of the table plate the entire table had to be converted. with such partial utilization of the leaves these conventional tables have not been much in use.

SUMMARY OF THE INVENTION

It is an object of the present invention to provide an improved table with expandable table plate.

It is another object of the invention to provide a table which is inexpensive and easy to manufacture and which can be equipped with a number of extension leaves so that the table plate can be extended partially or fully when desired.

These and other objects of the invention are attained by a table comprising a table plate provided with at least one extension leaf, said leaf including a mounting-free plate; the table being formed with at least one compartment positioned immediately below said table plate, said leaf being slidable into said compartment; said leaf further including at least strip-shaped and disk-shaped holding element connectable to said leaf plate, said leaf plate and said holding element having an equal thickness which corresponds to a thickness of said table plate and to a height of said compartment, said leaf plate having a front edge, said holding element projecting outwardly beyond said front edge and having an edge of a contour corresponding to that of said front edge, said edge limiting a surface of said holding element lying on said leaf plate, said table plate having an external edge having a contour corresponding to said contour of said front edge and limiting an upper side of said compartment.

The present invention is a very simple construction which offers the possibility to provide an expandable table without mounting elements. The table can be quickly converted to a large one, and a noticeable expansion of the table plate can be achieved simply depending on the number of leaves being utilized. The table plate is completed either by the usable surface of the extended plate or by holding elements which can be partially or fully inserted into the compartments formed under the table plate.

If, for example the leaf plate is inserted into the compartment the holding element completes the table plate. If the holding element is inserted into the compartment the leaf plate completes the table plate so that any desired extension of the usable surface of the table plate is obtained.

Mounting elements for the expansion of the table are no longer necessary because the leaf in each possible position is secured inside the compartment against shearing or tilting.

Costs of manufacturing of such tables can be substantially reduced due to abandonment of mountings, yet manipulating of the table is significantly facilitated.

If a plurality of extension leaves are provided only one of the leaves can be placed in the extended position while other leaves can remain in their compartments. Thus there is no longer necessary to use all the leaves to expand the usable table surface. This is particularly efficient if in each case either the holding element or the plate of each leaf enclose the same plane with the table plate. The vertical adjustment of the leaves can be avoided with the present invention.

It is also possible to store inside the table extension leaves of different shapes to use them in varieties.

If the table plate is rounded as a whole the leaf plate may have a quarter circular-shaped base plane, said holding element being disk-shaped and having a bi-convex base surface.

The table plate may have at a portion thereof projecting beyond said front edge of said leaf plate, magnets, said leaf plate having counter magnets arranged at places corresponding to those of said magnets.

The magnets may be also positioned inside the compartments.

The table may further include a supporting plate enclosing said compartment from below and having at a side thereof facing said compartment a layer of soft, elastic material, for example felt.

Radii of curvatures which form said bi-convex surface may be the same.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
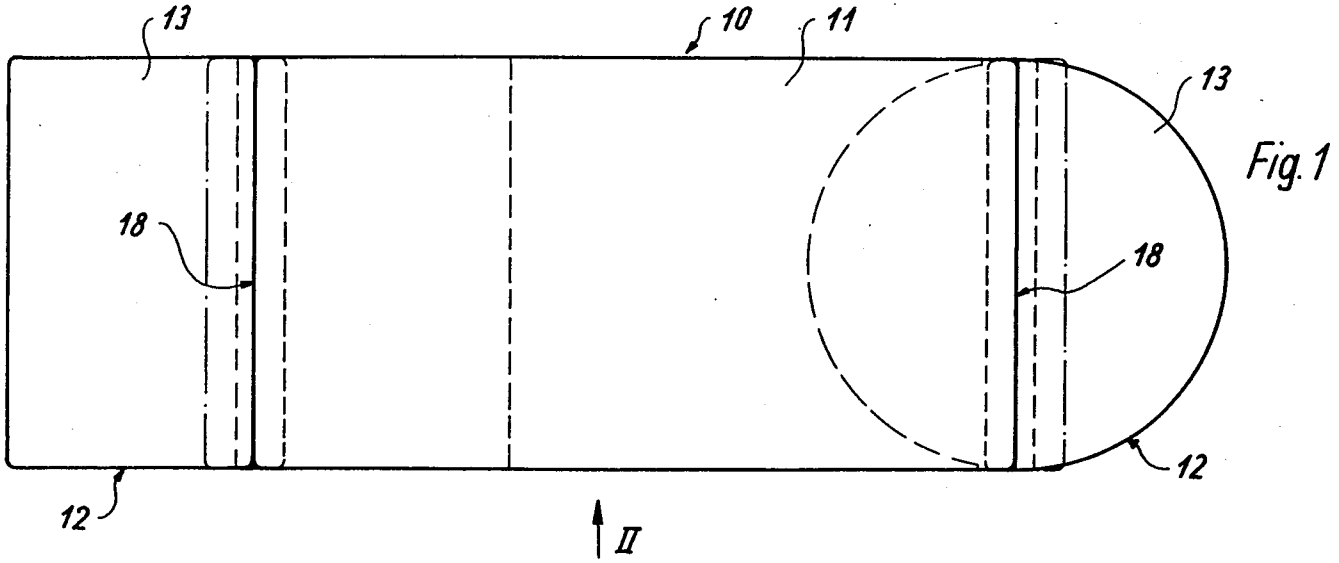
FIG. 1 is a top plan view of the table with two leaves which are shown in the use position.
Figure 2:
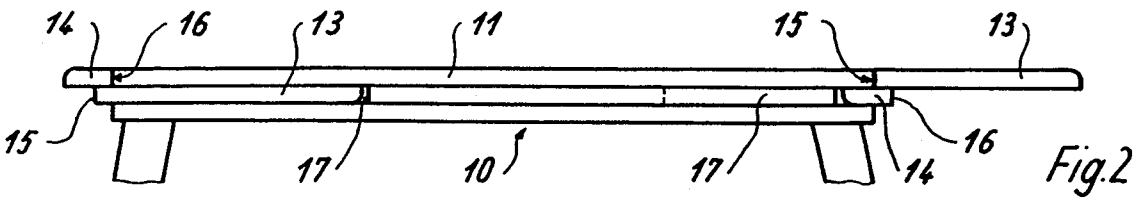
FIG. 2 is a side view of the table as seen from arrow II of FIG. 1 with the left-hand side shown in the non-use position.

Referring now to the drawings in detail, and firstly to FIGS. 1 and 2 thereof, it will be seen that reference numeral 10 designates a table which has a table plate 11 which is extendable by two leaves 12.

Each extension leaf 12 is formed of a plate 13 which enlarges the usable surface of the table and a supporting or holding element 14 connected to plate 13. The holding element can be strip-shaped and disc-shaped. In the embodiment of FIGS. 1 and 2 each supporting or holding element 14 is a strip.

As clearly seen from FIG. 2 the strip-like supporting element 14 overlaps the front edge 15 of the respective plate 13.

Supporting element 14 is limited in the region thereof lying on the plate 13 by edge 16 the contour of which corresponds to that of the front edge 15 of plate 13. As also shown in FIG. 2, a compartment or slide-in unit 17 is provided immediately below the table plate 11, for each leaf 12.

An external edge 18 of the table plate 11, which limits the respective compartment 17 has the same contour as that of the front edge 15 of plate 13 or respectively shaped edge 16 of supporting element 14.

The thickness of plate 13 corresponds to the thickness of the supporting element 14 and the thickness of table plate 11. The height of the compartment 17 is adapted to the thickness of plate 13 and supporting element 14 so that the following use possibilities result:

In the base position of the leaves 12 the respective plates 13 are inserted in their predetermined compartments 17 as shown at the left-hand side of FIG. 2. In this position the supporting element 14 completes the table plate 11 without extending the same.

If the table surface to be used should be extended the leaves 12 are firstly pulled out from boxes or compartments 17, and their supporting elements should be inserted into the compartments as shown at the right-hand side of FIG. 2. Plates 13 thus extend the usable table surface as shown in FIG. 1.

If the thickness of plates 13 corresponds to the thickness of plate 11 and also the thickness of the supporting elements 14 corresponds to the height of compartment 17 this results in that plates 13 are sufficiently reliably fixed by merely inserting the supporting elements 14 into compartments 17 and at the upper sides are flush with the table plate 11. This last advantage is attained when only one leaf 12 is utilized as shown in FIG. 2.

Figure 3:
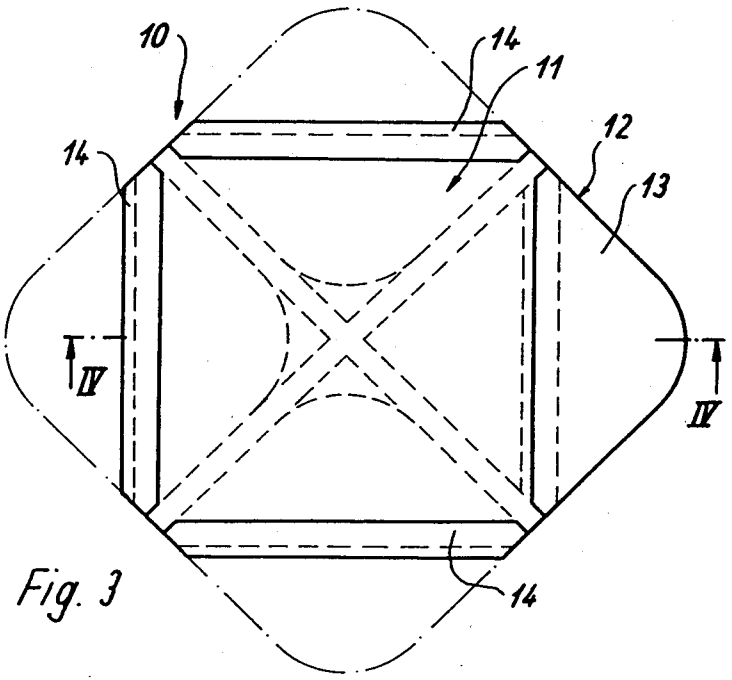
FIG. 3 is a top plan view of the table with the extension plate according to a further embodiment of the invention.
Figure 4:
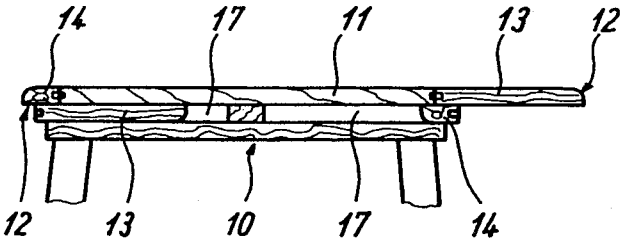
FIG. 4 is a cross-sectional view taken on line IV—IV of FIG. 3.

Table 10 shown in FIGS. 3 and 4 differs from the embodiment of FIGS. 1 and 2 in that it has a substantially square table plate 11 and four leaves by means of which the usable surface of the table is doubled. Leaves 12 are consisted of plates 13 and strip-like supporting elements 14.

Leaf plates 13 and supporting elements 14 can be interchangeably inserted into compartments 17 so that any desired shape and size of plate 11 can be obtained.

The manipulation and function of leaves 12 of FIGS. 3 and 4 correspond to those of FIGS. 1 and 2.

Figure 5:
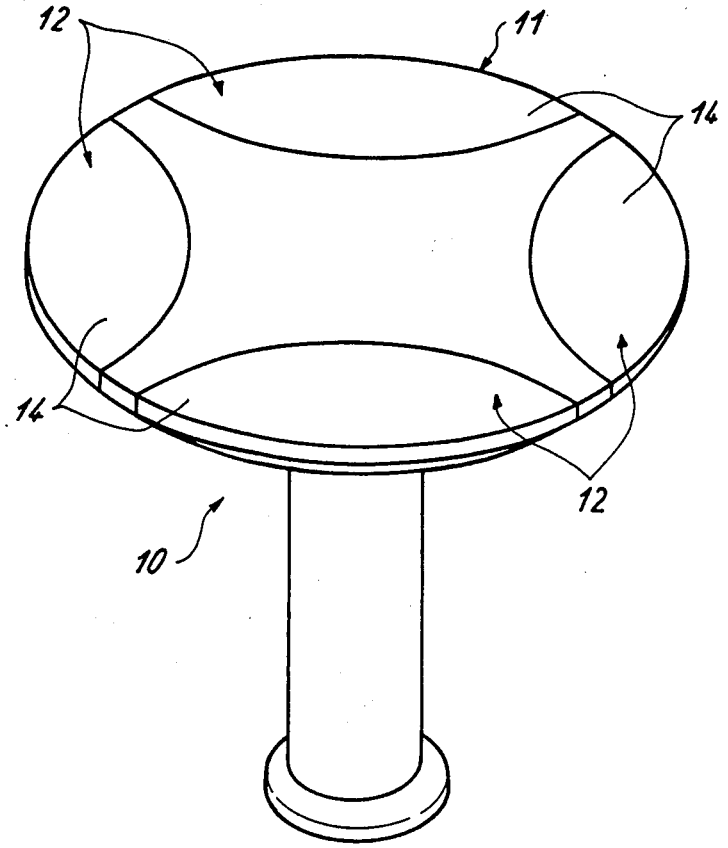
FIG. 5 is a perspective view of the table according to yet another modification.
Figure 6:
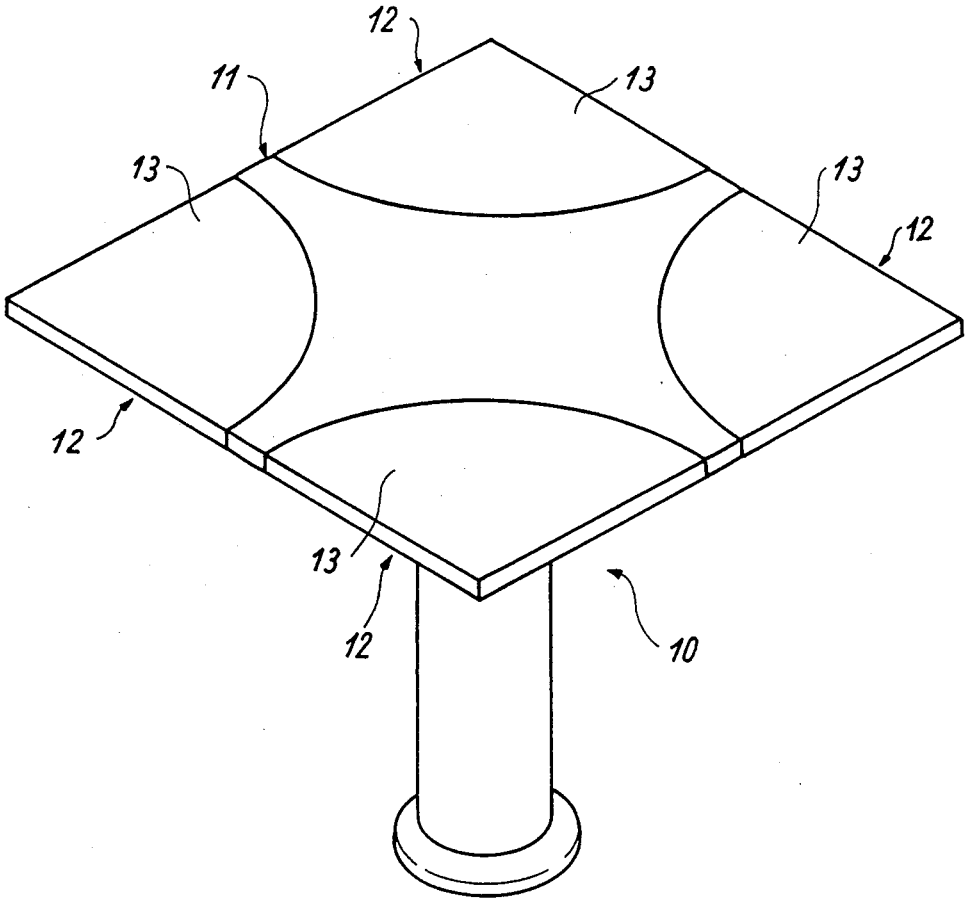
FIG. 6 is a perspective view of the table of FIG. 5 with the extended plate.

Table 10 illustrated in FIGS. 5 to 9 is provided with a rounded table plate 11 which has four leaves 12 which can be attached to the plate 11 so that a round or square table plate would result as shown in FIGS. 5 and 6.

Each leaf 12 includes the plate 13 and supporting element 14 connected thereto. Supporting element 14 can have a disk shape and a bi-convex base surface while respective plates 13 have approximately quarter circle-shaped ground plan.

Each disk-shaped supporting element 14 extends over the plate 13, namely over the curved front edge 15. Respectively curved is the edge 16 of the supporting element which lies on the plate 13. Each compartment 17 for receiving either the plate 13 or a portion of the supporting element 14 is also respectively shaped at the upper side thereof while plate 11 has curved external surfaces designated by reference numeral 18.

If plates 13 are inserted into respective compartments 17 table 10 has the shape shown in FIG. 5. In this case supporting elements 14 complete the table plate 11 to the fully round shape.

If leaves 12 are used for extending the usable table surface the supporting elements 14 in this case engage with their surfaces extending over the edges 15 of the plates 13 in the compartment 17. Thereby the front edges 15 of the plates 13 lie on respective external edges 18 of the table plate 11 so that again a completely closed table surface is provided.

If all leaves 12 are used as shown in FIG. 6 a substantially square table plate results. It is also possible in case of little room to be used to utilize one or two leaves 12. This is also possible because by using the leaves 12 the vertical position of the usable table surface is not changed.

Figure 9:
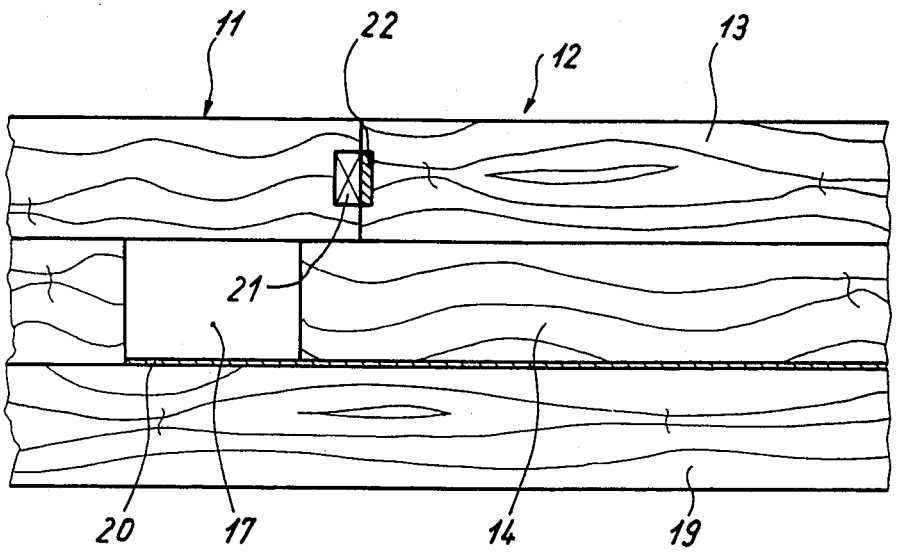
FIG. 9 is a section through the table plate in the region of the extension leaf inserted into the drawer.

As shown in FIG. 9 the compartment 17 is limited with a supporting plate 19 which is provided with a layer 20 of soft and elastic material, preferably fluffy felt. Due to this soft layer 20 the portion of the leaf 12 engaged in the compartment 17 is held in the drawer practically play-free. It is, of course understandable that such structure of the drawer 17 can be applied to the embodiments of FIGS. 1 to 4.

Figure 7:
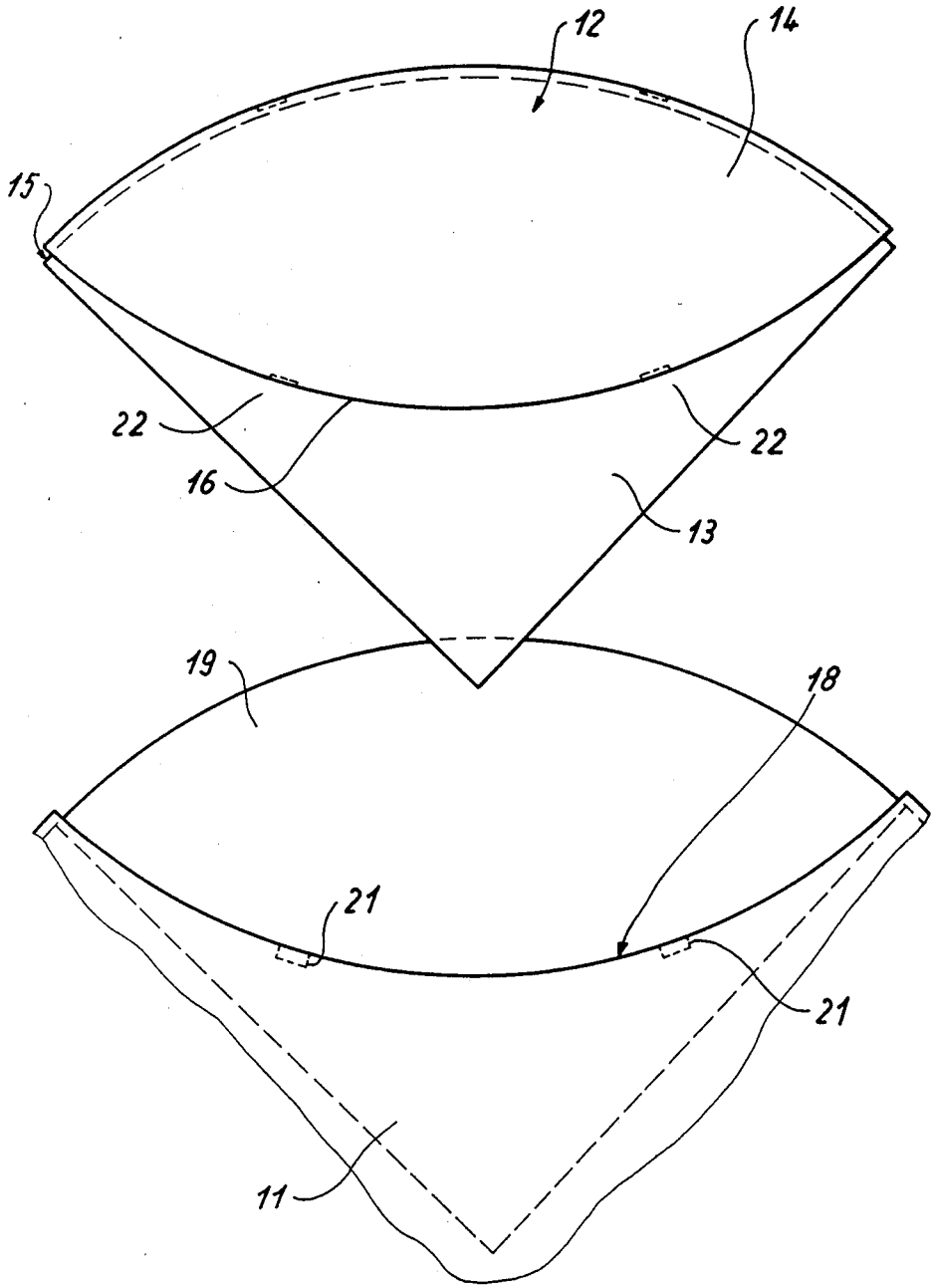
FIG. 7 partial top plan view of the table plate of the table of FIG. 5 with the extension leaf pulled out from the slide-in unit.
Figure 8:
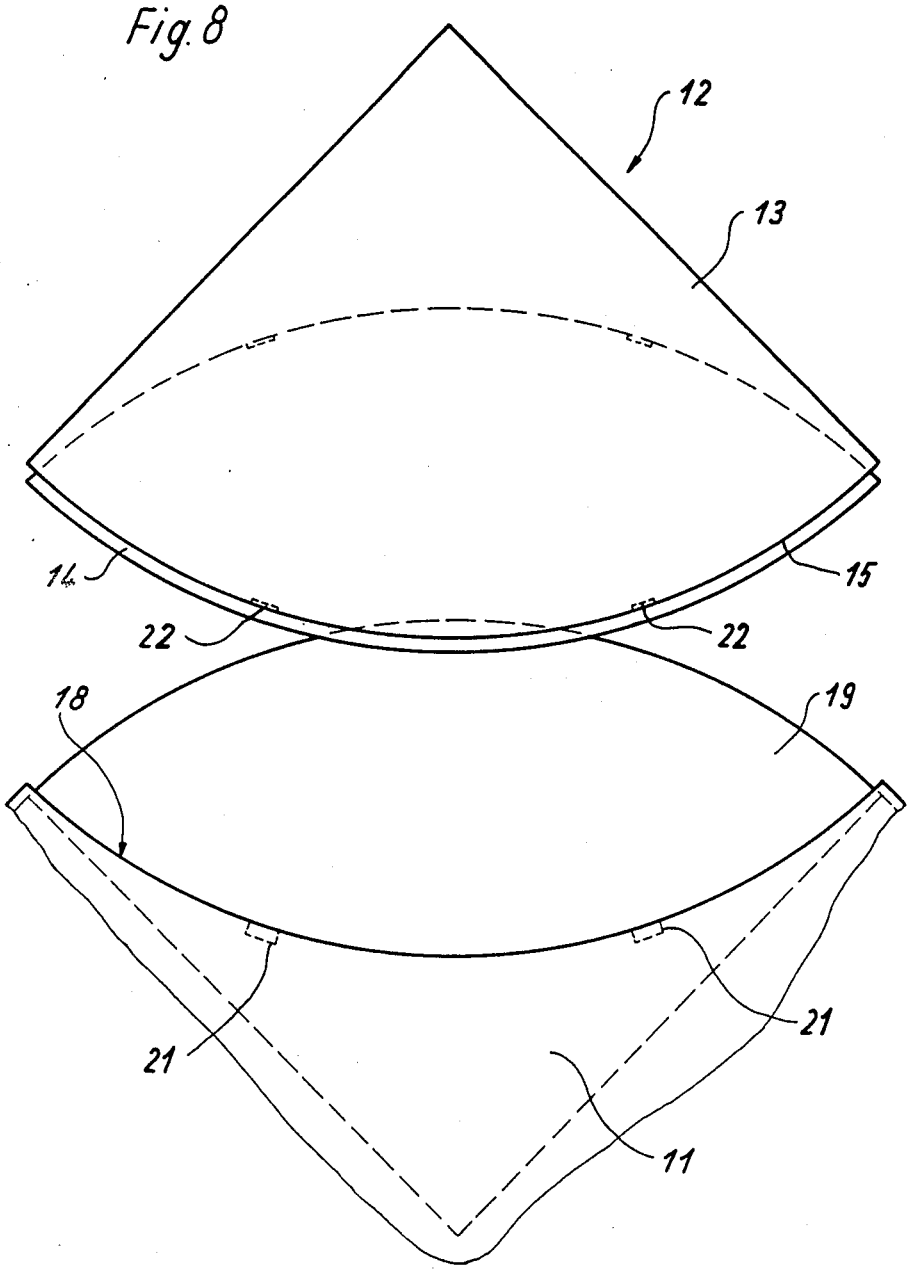
FIG. 8 is a view substantially corresponding to that of FIG. 7 but with the extension leaf turned by 180°.

As can be seen in FIGS. 7 to 9 magnets 21 and magnetic counterpieces 22 are provided, on the one hand, on the external edge 18 of the table plate 11 and, on the other hand, on the front edges 15 of plates 13 or edges 16 of the supporting elements 14. The position of each leaf inside the compartment 17 against non-intentional displacement will be easily secured by the magnets 21 and magnetic counterpieces 22 whereby a rigid and stable position of the leaves will be obtained. Further magnets can also be provided in the compartment 17

It should be also noted in reference to the embodiment shown in FIGS. 5 to 9 that for manufacturing reasons the bottom surface of each supporting element is shaped so that not only a bi-convex shape is obtained but also the curvature radii for that surface are the same.

The corners of the quarter circular plates 13 can be, of course, rounded to a lesser or greater degree.

Wood or plastic or any other furniture customary material can be used as a material for the table plate 11 and leaves 12. A material combination can be applied as well; for example leaves 12 can be made of a material different than that of table plate 11. There is also a possibility that plates 13 and supporting elements 14 of each leaf 12 be made of different materials.

It will be understood that each of the elements described above, or two or more together, may also find a useful application in other types of tables differing from the types described above.

While the invention has been illustrated and described as embodied in a table, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A table comprising a table plate having a predetermined thickness and an outer edge with a predetermined contour; at least one compartment positioned immediately below said table plate and having a predetermined height; at least one extension leaf having a mounting-free leaf plate and at least one strip-shaped holding element mounted on said leaf plate, said leaf plate and said holding element having an equal thickness which corresponds to the thickness of said table plate and to the height of said compartment, said leaf plate having a front edge, said holding element projecting outwardly beyond said front edge of said leaf plate and having an edge, said front edge of said leaf plate and said edge of said holding element having the same contour which corresponds to said contour of said outer edge of said table plate, so that said leaf plate and said holding element are each insertable in said compartment so that upon insertion of said holding element in said compartment the upper surface of said leaf plate and said table plate form a single plane, while upon inserting said leaf plate in said compartment, the upper surfaces of said holding element and said table plate form a single plane.

2. The table as defined in claim 1 wherein said table plate is round as a whole, said leaf plate having a quarter circular-shaped base plane, said holding element being disk-shaped and having a bi-convex base surface.

3. The table as defined in claim 1; and further comprising magnets (21) provided on said table plate at a portion thereof projecting beyond said front edge (15) of said leaf plate (13), and countermagnets (22) provided on said leaf plate at places corresponding to those of said magnets (21).

4. And further comprising magnets (21) provided on said table plate at a portion thereof projecting beyond said front edge (15) of said leaf plate (13), and countermagnets (22) provided on said leaf plate at places corresponding to those of said magnets (21).

5. The table as defined in claim 1, further including a supporting plate (19) enclosing said compartment from below and having at a side thereof facing said compartment a layer (20) of soft, elastic material.

6. The table as defined in claim 5, wherein said material is fluffy felt.

7. The table as defined in claim 2, wherein radii of curvature of said bi-convex surface are the same.

8. The table as defined in claim 1, wherein corners of said leaf plate are rounded.

9. The table as defined in claim 1 including a plurality of said leaves, said leaves being of different configurations.

* * * * *